United States Patent [19]

Watahiki et al.

[11] Patent Number: 4,778,297

[45] Date of Patent: Oct. 18, 1988

[54] HAMMER COIL COOLING MEANS IN LINE PRINTER

[75] Inventors: Shinichi Watahiki; Takanobu Agake; Nobuhiko Itoh; Masaaki Koseki, all of Ibaraki, Japan

[73] Assignee: Hitachi Koki Company, Limited, Tokyo, Japan

[21] Appl. No.: 899,579

[22] Filed: Aug. 25, 1986

[30] Foreign Application Priority Data

Nov. 8, 1985 [JP] Japan ..... 60-251168

[51] Int. Cl.[4] ..... B41J 29/00

[52] U.S. Cl. ..... 400/719; 101/93.05; 400/125; 400/174

[58] Field of Search ..... 400/125, 125.1, 174, 400/175, 719; 101/93.03, 93.04, 93.05

[56] References Cited

U.S. PATENT DOCUMENTS

| | | | |
|---|---|---|---|
| 4,388,009 | 6/1903 | Kumagai et al. | 400/719 X |
| 4,407,591 | 10/1983 | Adamoli et al. | 400/719 X |
| 4,602,881 | 7/1986 | Prevignano et al. | 400/719 X |
| 4,697,939 | 10/1987 | Ara | 400/719 |

FOREIGN PATENT DOCUMENTS

| | | | |
|---|---|---|---|
| 89963 | 7/1981 | Japan | 400/719 |
| 80068 | 5/1982 | Japan | 400/719 |
| 177373 | 10/1983 | Japan | 400/719 |
| 49988 | 3/1984 | Japan | 400/719 |
| 30379 | 2/1985 | Japan | 400/719 |

OTHER PUBLICATIONS

IBM Tech. Disc. Bulletin, "Conduction-Air-Cooled Hammer Mounting Bar", Stutzman, vol. 27, No. 5, Oct. 1984, pp. 2978-2979.

IBM Tech Disc. Bulletin, "Double-Sided Thermal Conduction Module Cooling", vol. 28, No. 3, Aug. 1985, p. 1094.

*Primary Examiner*—Edgar S. Burr
*Assistant Examiner*—James R. McDaniel
*Attorney, Agent, or Firm*—Sughrue, Mion, Zinn, Macpeak & Seas

[57] ABSTRACT

A cooled print hammer assembly in which a plurality of hammer coils are formed in a resin member having a recess in which is placed a cooling fin. The opened faces of the fins are placed adjacent a plate of the frame of the print hammer assembly so that closed forced-air ducts are defined by the fins and the frame plate. Additionally, partitions may be placed on the sides of the fins so that the external sides of the fins are cooled.

5 Claims, 6 Drawing Sheets

HAMMER COIL COOLING MEANS IN LINE PRINTER

BACKGROUND OF THE INVENTION

1. Field of the Invention

The present invention generally relates both to a cooling apparatus and to a printer. In particular, it relates to a cooling apparatus for cooling a hammer coil which drives a print hammer used in a character-printing mechanism of a line printer.

2. Background Art

FIG. 1 shows one example of a conventional print hammer mechanism which is used in a character-printing mechanism of a line printer. A plurality of print hammers 51 are aligned linearly in a character printing position, and each of the print hammers 51 is normally held in a stationary position by a return spring 52 and a plunger 53. When a character is to be printed, the print hammer 51 is driven by the electrical actuation of a hammer coil 57, so that a head 58 of the hammer 51 hits a character formed on a type belt 54. Located between the head 58 and the type belt 54 are a paper sheet 55 and an ink ribbon 56 so that the character is printed on the paper 55.

In FIG. 1, a plurality of heads 58 are aligned in a direction perpendicular to the drawing, and their print hammers 51 alternate above and below the row of heads 58 with the hammer coils 57 also alternating. The distance or pitch between the neighboring heads 58 is about 0.1 inches (2.5 mm), so that the distance between the neighboring hammer coils 57 is about 0.2 inches. The latter distance or pitch is extremely small. That is, hammer coils are located extremely close to one another. Therefore, if the print hammers 51 are operated at high speed, the hammer coils 57 generate a large quantity of heat. This heat changes the electrical resistance of the hammer coil 57 and thus degrades the character printing quality. In order to eliminate this problem, cooling fins 61, as shown in FIG. 2, are disposed at the rear portion of the hammer coils 57 with their openings facing upwardly or downwardly. However, sufficient heat radiation from ambient air cooling may not be obtainable if the line printer is operated in a high speed print mode for long periods of time. Therefore, mere provision of the fins cannot solve the problems of the prior art.

In order to further improve the prior art device, as shown in FIG. 3, a proposal has been made in which a blower 71 is provided to feed cooling air, and the air is divided in a hammer duct 73 to permit the cooling air to impinge on the two sets of cooling fins 61, to thereby perform forcible cooling of the hammer coils. However, with this structure, the cooling air passing between the fins is subjected to relatively large flow resistance at a grooved portion defined by the fins since the fins 61 have a small dimension. As a result, cooling air may not pass through the entire length of the fins but may escape upwardly therefrom as shown by the arrows. Accordingly, it would be difficult to provide uniform cooling effect and to enhance cooling efficiency.

SUMMARY OF THE INVENTION

It is therefore, an object of the present invention to overcome the above-described prior art disadvantages, and to provide an improved cooling means for cooling hammer coils closely aligned with one another.

Another object of the invention is to provide such cooling means capable of effectively cooling the hammer coils.

Still another object of the invention is to provide such cooling means having compact size while minimizing leakage of cooling air.

These and other objects of the invention will be attained according in the present invention by a guide member associated with the cooling fins. The cooling fin and the guide member serve as a cooling air duct through which cooling air passes to forcibly cool the hammer coils.

A character-print mechanism includes a plurality of print hammers aligned along a character print position and a plurality of hammer coils driving the print hammer. External surfaces of a predetermined number of the hammer coils are provided integrally with a resin member. The resin member is formed with a recess extending along its longitudinal direction. Cooling fins are disposed in the recess and their openings face outwardly. Further, guide bmembers are provided in the vicinity of opening portions of the fins. The guide members extend along a longitudinal direction of the cooling fins, to thereby provide a duct defined by the fins and the guide member. Cooling air passes through the duct.

DETAILED DESCRIPTION OF THE PREFERRED EMBODIMENTS

A first embodiment according to this invention will be described with reference to FIGS. 4–7. In FIG. 5, a hammer coil portion is shown in which a predetermined number of hammer coils 11 are integrally arranged within a resin member 12 at the outer surfaces of the hammer coils 11. A recess 13 is formed at the rear side surface of the resin member 12. The recess 13 extends along the longitudinal direction of the resin member 12. Cooling fins 14 having a length approximately equal to the length of the recess 13 are fixed to the recess 13 by means of, for example, an adhesive agent.

Figure 6:
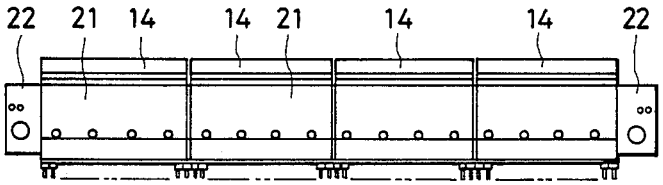
FIG. 6 is a front view showing print hammer assemblies fixed to a hammer base.

In FIG. 6 are shown four print hammer assemblies 21, each incorporating therein a number of hammer coils 11. An end face of an assembly 21 is in contact with the end face of the neighboring assembly 21 except for the end faces at the two ends, and these are mounted on a hammer base 22. With this structure, end faces of the cooling fins 14 are also in abutment of the end faces of the neighboring cooling fins 14.

Figure 1:
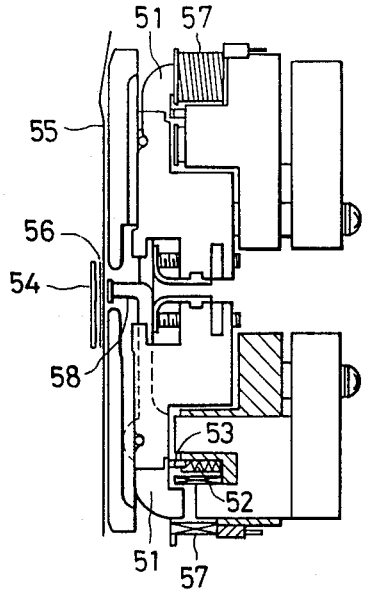
FIG. 1 PRIOR ART
FIG. 1 is a side view showing a print hammer portion of a conventional print mechanism.
Figure 2:
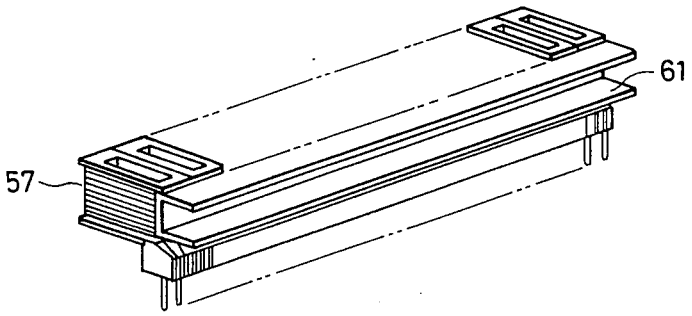
FIG. 2 PRIOR ART
FIG. 2 is a perspective view showing a hammer coil portion of a conventional print mechanism.
Figure 3:
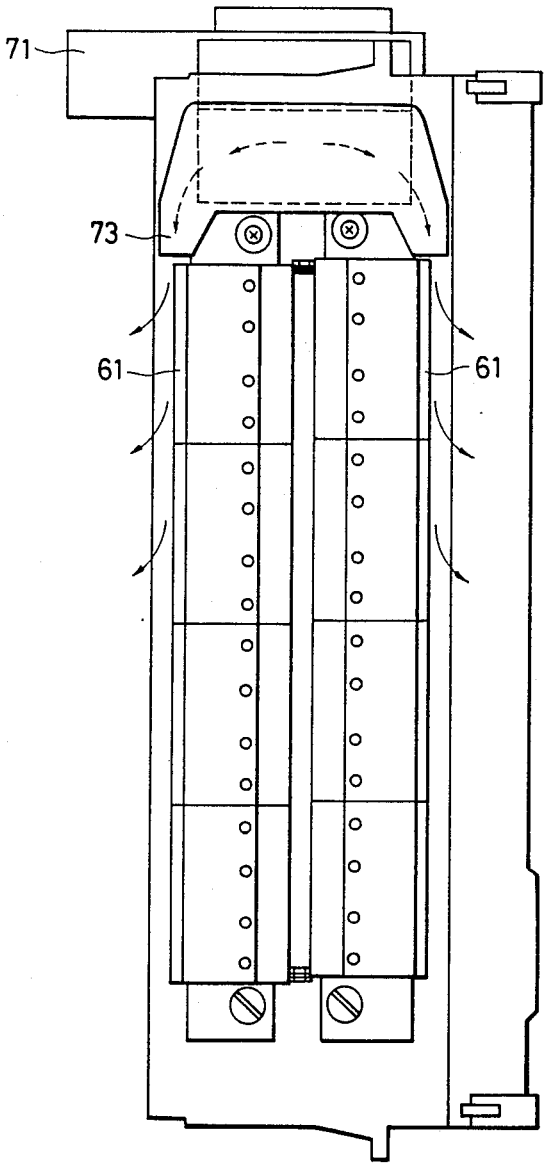
FIG. 3 PRIOR ART
FIG. 3 is a front view showing the conventional print hammer portion, in which leakage of cooling air is shown.
Figure 4:
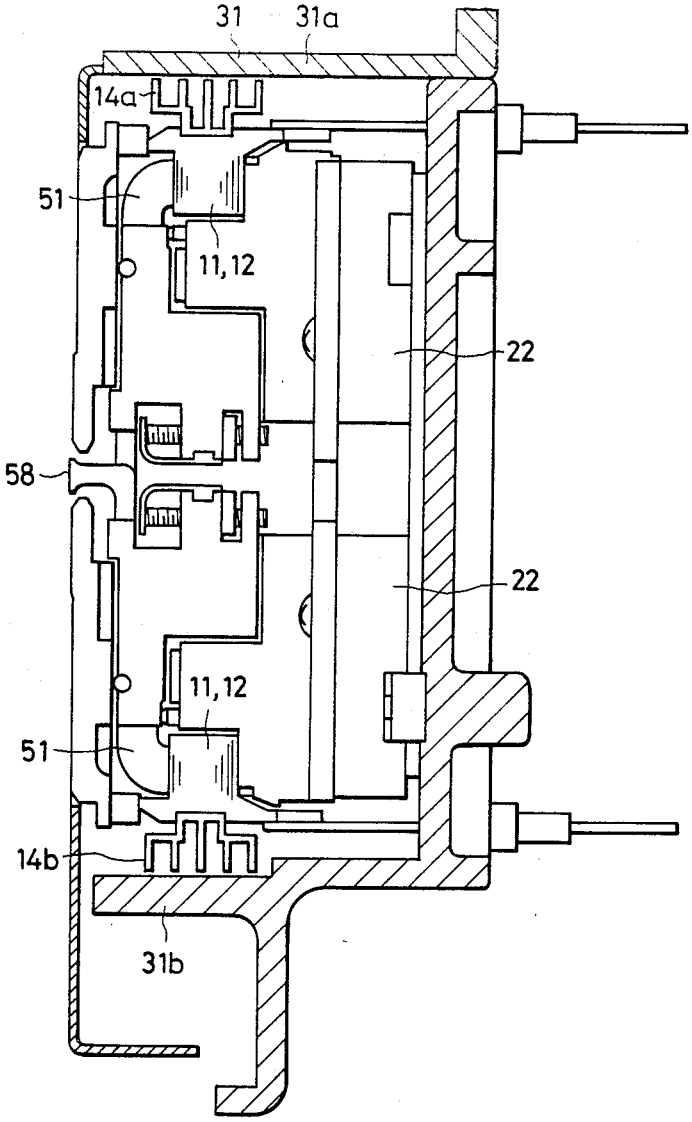
FIG. 4 is a side view showing a first embodiment of the present invention.
Figure 5:
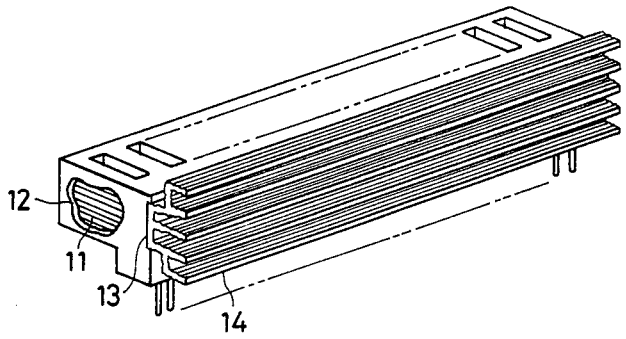
FIG. 5 is a perspective view showing a hammer coil portion.

As shown in FIG. 4, hammer bases 22 are disposed at upper and lower positions in a mechanical frame 31, so that corresponding hammer heads 58 alternately extend through hammers 51 from upper and lower hammer bases 22. The mechanical frame 31 is provided with upper and lower plates 31*a* and 31*b* which function as guide members according to the present invention. Specifically, the upper and lower plates 31*a* and 31*b* function as lids to cover the openings of the cooling fin 14, so that the combination of the upper plate 31*a* and the upper fins 14*a*, and another combination of the lower plate 31*b* and lower fins 14*b* provide cooling air ducts. Therefore, these plates 31*a* and 31*b* are positioned as closely as possible to the fins 14*a* and 14*b*.

Figure 7:
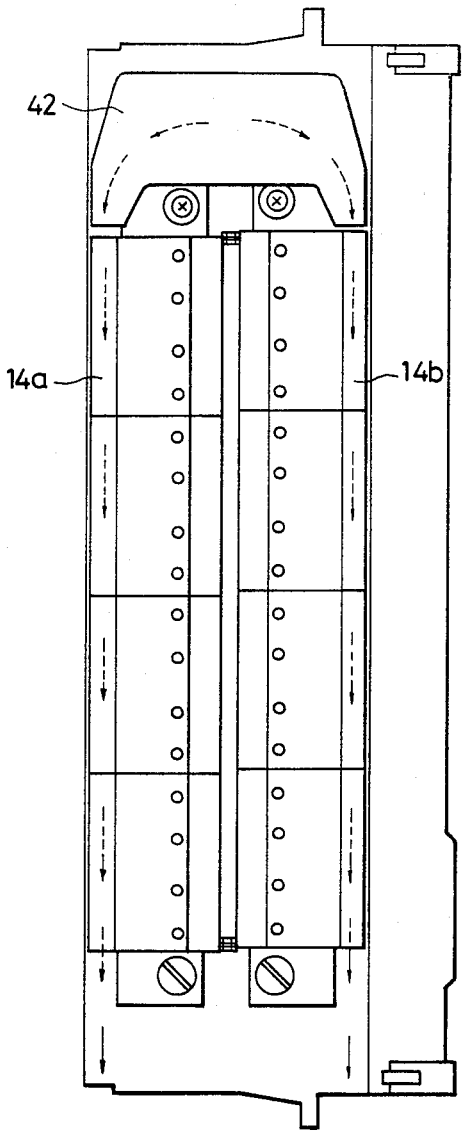
FIG. 7 is a front view showing print hammer portion in which cooling air currents are shown.

As shown in FIG. 7, cooling air fed from a blower (not shown) is introduced into one set of distal ends of the respective fins 14*a* and 14*b* through a hammer duct 42, and the cooling air pass through the length of the cooling fins 14 because of the fluid guiding effect provided by means of guides such as the upper and lower plates 31*a* and 31*b* which guide the fluid flow of the air. The air is discharged from the guides from the other distal ends of the fins 14*a* and 14*b*. Therefore, leakage of cooling air from the openings of the fins 14*a* and 14*b* can be minimized.

Figure 8:
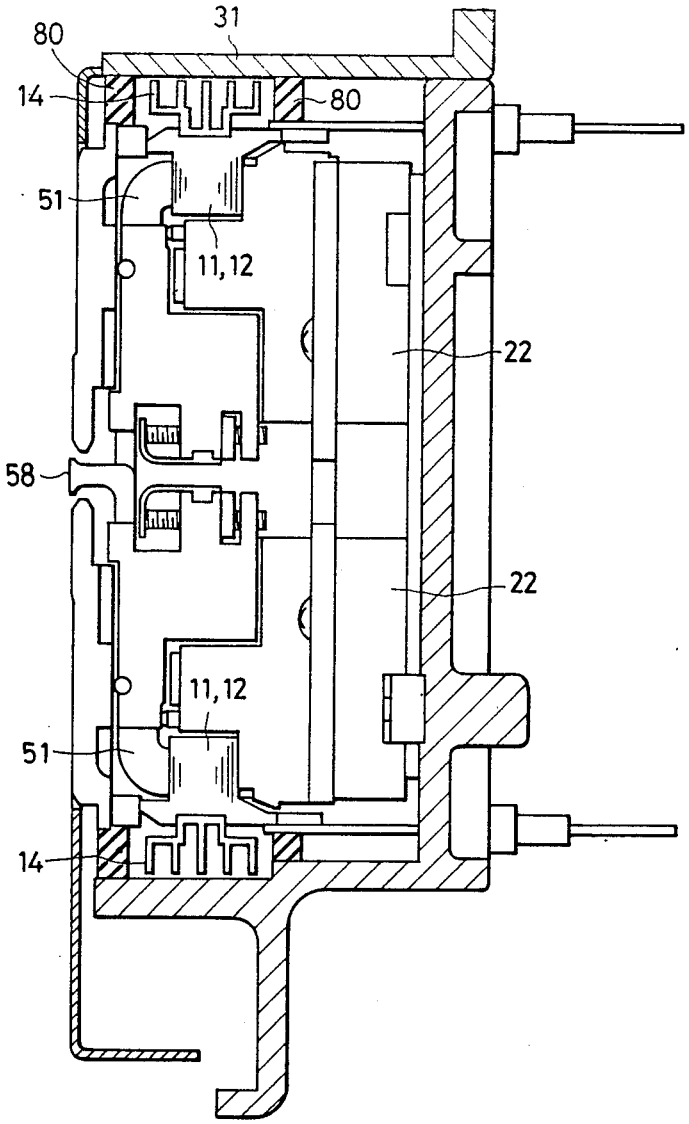
FIG. 8 is a side view showing a second embodiment of the present invention.

FIG. 8 shows a second embodiment of this invention. As shown in FIG. 8, partitions 80 are provided on both lateral sides of the fins 14. The partitions 80 are secured to the mechanical frame 31. Cooling air is introduced into a space defined by the ducts, the partitions 80 and the plate 31, so that both the internal and external sides of the fins 14 can be cooled, whereby cooling efficiency of the hammer coils is further enhanced. An elastic material may be used as the material of the partitions 80.

As described above, according to the present invention, since the cooling fins can be utilized as cooling air ducts, leakage of cooling air can be minimized, to thus enhance cooling efficiency. Further, it is unnecessary to prepare special mechanical components to provide cooling air ducts, so that cooling means can be simplified at low cost, and there results a compact character-printing mechanism.

We claim:

1. A character printing device having at least one hammer assembly and a frame for supporting said hammer assembly, comprising:

a plurality of print hammers in said hammer assembly and aligned with one another along an aligning direction at a character print position;

a plurality of hammer coils in said hammer assembly for driving said print hammers;

an assembly member for integrally assembling a predetermined number of said hammer coils, said assembly member being formed of a resin material and embedding at least one surface of each of said hammer coils, a recess being formed in said assembly member extending in said aligning direction;

a cooling fin assembly having a base portion received in said recess, said cooling fin assembly having a plurality of cooling fins facing outwardly from said assembly member; and a plate integral with said frame and positioned closely adjacent end portions of said cooling fins for defining in cooperation with said cooling fins a duct for cooling air.

2. The character printing device of claim 1, further comprising partitions fixed to said frame and disposed on opposite sides of said cooling fin assembly.

3. The character printing device of claim 2, wherein said partitions are formed of an elastic material.

4. The character printing device of claim 1, wherein said hammer coils are embedded on at least four sides by said assembly member.

5. The character printing device of claim 1, wherein a plurality of said assembly members are provided, disposed closely adjacent one another.

* * * * *